United States Patent [19]

Ellis et al.

[11] Patent Number: 4,976,829

[45] Date of Patent: Dec. 11, 1990

[54] COATING SUBSTRATES

[76] Inventors: John Ellis, 308 Walton Road, East Molesey, Surrey, England, KT8 0HY; John W. Nicholson, 63 Morland Close, Hampton, Middlesex, England, TW12 3YY; Alan D. Wilson, 49 Shepherds Way, Liphook, Hampshire, England, GU30 7HH

[21] Appl. No.: 422,522

[22] Filed: Oct. 17, 1989

Related U.S. Application Data

[62] Division of Ser. No. 257,096, Oct. 13, 1988.

[30] Foreign Application Priority Data

Nov. 3, 1987 [GB] United Kingdom ..... 8725714

[51] Int. Cl.[5] ..... C25D 11/34

[52] U.S. Cl. ..... 204/38.7; 204/56.1

[58] Field of Search ..... 204/38.3, 38.7, 42, 204/56.1

[56] References Cited

U.S. PATENT DOCUMENTS 2,215,165 9/1940 Sumner ..... 204/42

FOREIGN PATENT DOCUMENTS 2173805A 10/1986 United Kingdom .

OTHER PUBLICATIONS

Nishihara, T., et al., "Surface Treatment of Tinned Steel Sheets" Abstract, 159358n.

*Primary Examiner*—T. M. Tufariello

*Attorney, Agent, or Firm*—Nixon & Vanderhye

[57] ABSTRACT

A metallic container for beverage is protected from its contents by electrodeposited zinc, which is anodized in alkali then anodically reacted with weak poly(acrylic acid) and finally cured at 85° C. at 100% relative humidity.

8 Claims, No Drawings

COATING SUBSTRATES

This is a division of application Ser. No. 257,096, filed Oct. 13, 1988.

This invention relates to coating metallic substrates, particularly to prevent their interaction with fluid media which they might otherwise contact, and to substrates so coated, particularly for packaging, e.g. for beverages.

Polyelectrolyte coatings such as poly(acrylic acid) are known for this purpose but have first to be insolubilised. Thus, Japanese Pat. Publication No. 74 31604 suggests that tinned steel sheet may be provided with scratch-resistant coatings which have good adhesion to paint by dipping the sheet into a solution containing poly(acrylic acid) and/or an acrylic acid-vinyl alcohol copolymer and then heating to a temperature below the melting point of tin. However, such coatings are found not to be acid resistant.

In an attempt to overcome this drawback, UK Pat. application No. GB2173805A describes a process for the preparation of a coherent protective layer on a metallic substrate, which process in one example comprises applying to the substrate an aqueous solution of poly(acrylic acid) partially neutralised by sodium hydroxide, and heat-curing the layer so formed in air for 10 minutes at 235°C.

According to the present invention, a process for the preparation of a coherent protective layer on a metallic surface comprises (preferably electrochemically) depositing on the surface a layer of a metal capable of forming a basic oxide optionally forming said oxide optionally anodically and reacting the deposit with a (preferably electrolytically applied) aqueous solution of a homo- or copolymer of poly(acrylic acid) or an even more highly carboxylated unsaturated-carbon-backbone acid or a hydrolysable precursor thereof.

The deposited metal is preferably zinc, in which case either one of the following is not optional/preferable but essential: zinc oxide is formed, or the poly(acrylic acid) is applied to the substrate electrochemically; the latter is preferred preferably at under 1% acid concentration for under 1 minute. Aluminium does not form a satisfactory basic oxide for the purposes of the invention. The deposited metal may be tin, in which case the step of forming its oxide is not optional but is essential, and electrolytic application of the acid is not preferred.

The aqueous solution is preferably less concentrated than 5% by weight, preferably less than 1% by weight, and the acid may be encouraged to react with the deposit by making the latter the anode in the aqueous solution. This optional anodising may be additional to the optional (earlier) anodising to form the basic oxide. Electrolysis is advantageous in ensuring an even and controlled formation of the layer, and may be brief, e.g. under 1 minute.

The deposit is advantageously reacted with the acid by curing it at from 80°C. to 100°C. for from 10 to 60 minutes at at least 80%, (preferably 100%) relative humidity, although this can be replaced by ageing under room conditions for a week. Both the curing and the ageing can non-preferably be omitted.

The reaction product (thus, preferably zinc polyacrylate) is preferably from 1 to 50 more preferably 5 to 10, microns thick.

The invention extends to the substrate thus coated, and the containers or other artefacts made from the coated substrate.

The invention will now be described by way of example.

All the examples were performed on degreased mild steel substrates known as coupons, except where indicated. The coupons were flat 1 cm × 2 cm.

STEP A

An initial layer of zinc was deposited electrolytically by making the mild steel the cathode and a pure zinc rod the anode, and passing current for 5 minutes at 1.2V (about 0.5A) through a bath consisting of $ZnSO_4.7H_2O$ (249 g $dm^{-3}$), $NH_4Cl$ (15 g $dm^{-3}$) and $Al_2(SO_4)_3.18H_2O$ (14.2 g $dm^{-3}$). This resulted in a zinc coating weighing about 2 mg $cm^{-2}$.

STEP B

Step A was followed by electrolytic oxidation of the zinc coating, which was made the anode, and a pure zinc rod the cathode. The electrolyte was 0.5M KOH conditioned by dissolving a small amount of zinc in it prior to use. Current was passed at 3.5V (about 0.2A) for 2 minutes at 20°C. This formed a porous, black coating of a non-stoichiometric form of zinc oxide.

STEP C

The substrate was dipped in a solution of 20% poly(acrylic acid) (viscosity ×1.8 poises) for 1 minute, and changed colour from black to grey.

STEP D

The substrate from Step C, having been removed from the acid, was cured by heating at 85°C. and 100% relative humidity (e.g. steam curing) for 30 minutes.

EXAMPLE 1

Steps A, B, C and D were performed in order. Infrared analysis showed the cured film to consist almost entirely of zinc polyacrylate. The film was glossy, resistant to cold water, showed good adhesion, and could be flexed through 180° on a 6 mm mandrel without cracking, as in BS 3900 Part El of 1970.

EXAMPLE 2

Instead of the substrate being of mild steel, it was of aluminium, which was abraded with emery paper, degreased and then etched in 20% hydrochloric acid. Then Steps A, B, C and D were performed in order. The film was glossy, resistant to cold water, showed good adhesion, and could be flexed through 180° on a 6 mm mandrel without cracking, as in BS 3900 Part E1 of 1970.

EXAMPLE 3

Steps A, C and D were performed in order. Thus, the poly(acrylic acid) coating was applied non-electrolytically to a substrate of pure zinc. This Example is therefore not according to the invention.

The cured film had good adhesion and could be flexed through 180° and a 6 mm mandrel without cracking. The initial water resistance of the film was poor but improved somewhat after 1 week's ageing under room conditions.

EXAMPLE 4

Step A was performed, and followed by a Step $C^1$, being a modification of Step C. In Step $C^1$, poly(acrylic acid) was applied to the substrate electrolytically, according to the invention. The electrolytic bath contained a 0.5% solution of the half sodium salt of poly(a-crylic acid). The substrate was made the anode and 0.2A was allowed to flow for 30 seconds. (In a further experiment the 0.2A was allowed to flow for only 15 seconds. The film quality was but slightly affected.)

Step D (85°C. full-humidity curing) was omitted, the film being simply allowed to dry under room conditions. Although not glossy, the film was adequately hard, resistant to cold water, adhered well and could be flexed through 180° on a 6 mm mandrel without cracking.

EXAMPLE 5

Step A was performed, followed by Step $C^1$ (see Example 4) in which the 0.5% solution was however replaced by a 5% solution. Example 5 gave the same results as Example 4, except that the water resistance of the film was inferior, which could however by rectified by performing Step D. (Compare 31 May and 11 Oct. 1984 texts).

EXAMPLE 6

Steps A, B, and $C^1$ were performed in order, with the Step $C^1$ being tried in all four combinations (electrolysis 15 seconds/30 seconds; acid concentration 0.5%/5%). The resulting films were all satisfactory, but it was found that the longer times at higher currents (e.g. 0.5A) were inferior.

EXAMPLE 7

Four variations were tried, all including steps A and D, with the modification that Step D was quadrupled in duration to 2 hours. The four variations differed in the processes applied between Steps A and D, thus: (i) Step $C^1$ (15 seconds); (ii) $C^1$ (acid strengthened to 5%; (iii) Step B (3 minutes) then (i); (iv) Step B (3 minutes) then (ii). The resulting films were all glossy and scratch-resistant, and resistant to both cold and boiling water. Apart from (iv), which failed the 6 mm mandrel bend test, all showed good adhesion and flexibility.

EXAMPLE 8

Metallic tin does not react with polyacrylic acid, but SnO does. Therefore a method of producing a suitably reactive SnO film was devised. Metallic tin was electrodeposited onto a standard mild steel coupon (the cathode) from a standard hot (85°C.) stannate bath at 0.4A. The bath contained 12.5 g/dm$^3$ NaOH, 80 g/dm$^3$ $Na_2SnO_3$ and 0.4 g/dm$^3$ $Na_2CO_3$; the anode was pure metallic tin. The electrodeposited tin was then oxidised by making it now the anode in a phosphate bath containing 100 g/dm$^3$ $Na_2HPO_4$, 20 g/dm$^3$ (preferably 50 g/dm$^3$) $B(OH)_3$, at 0.4A, using a stainless steel cathode. (Although a black SnO surface could be produced by anodising in a plain boiling phosphate bath for 5 minutes at 0.4A on a 1×2 cm coupon, this when dip-coated in poly(acrylic acid) had no water stability, whether cured or uncured. As an additive in the phosphate bath, boric acid had the effect of beneficially increasing the reactivity of the SnO film). After steps C and D, the coating showed good water stability and was resistant to light scratching. The method was then tried on commercial tinplate and gave hard glossy water stable coatings on curing.

We claim:

1. A process for producing a coherent protective layer on a metallic surface, said process comprising the steps of:

forming a layer of tin oxide on the metallic surface; and reacting the tin oxide layer with an aqueous solution of a homo- or copolymer of polyacrylic acid) or even more highly carboxylated unsaturated-carbon-backbone acid or a hydrolyzable precursor thereof.

2. A process according to claim 1, wherein said tin oxide layer is deposited on the surface electrochemically.

3. A process according to claim 1, wherein said tin oxide is formed anodically.

4. A process according to claim 2, wherein said tin oxide is formed anodically in the presence of borate.

5. A process according to claim 2, wherein the electrolysis continues for under one minute.

6. A process according to claim 1, wherein the acid has a concentration of under 5%.

7. A process according to claim 6, wherein said concentration is under 1%.

8. A process according to claim 1, wherein the deposit with acid is cured from 80°C. to 100°C. for from 10 to 60 minutes at at least 80% relative humidity.

* * * * *